US005830082A

United States Patent [19]

White

[11] Patent Number: 5,830,082

[45] Date of Patent: Nov. 3, 1998

[54] GOLF CHIPPER CLUB CONSTRUCTION

[76] Inventor: Larry J. White, 2626 Country Club Rd., Indianapolis, Ind. 46234

[21] Appl. No.: 823,112

[22] Filed: Mar. 24, 1997

[51] Int. Cl.[6] ..... A63B 53/04; A63B 53/14

[52] U.S. Cl. ..... 473/294; 473/314; 473/328

[58] Field of Search ..... 473/289, 290, 473/291, 194, 316, 313, 314, 324, 325, 328, 349, 350, 340, 245, 296, 228, 231

[56] References Cited

U.S. PATENT DOCUMENTS

| | | | |
|---|---|---|---|
| 622,699 | 2/1899 | Lowe . | |
| 1,617,090 | 2/1927 | Worthington . | |
| 2,784,969 | 3/1957 | Brandon | 473/290 |
| 3,079,157 | 2/1963 | Turner | 473/328 |
| 3,083,969 | 4/1963 | Bills, Jr. . | |
| 3,138,386 | 6/1964 | Onions . | |
| 3,655,188 | 4/1972 | Solheim | 473/290 |
| 3,679,207 | 7/1972 | Florian | 473/294 |
| 4,163,554 | 8/1979 | Bernhardt | 473/294 |
| 4,592,552 | 6/1986 | Garber | 473/294 |
| 4,854,580 | 8/1989 | Kobayashi . | |
| 5,125,662 | 6/1992 | Antonious . | |
| 5,326,105 | 7/1994 | Fenton, Jr. . | |
| 5,328,185 | 7/1994 | Finnigan et al. | 473/294 |
| 5,452,891 | 9/1995 | Thomas | 473/294 |
| 5,549,296 | 8/1996 | Gilbert . | |

*Primary Examiner*—Sebastiano Passaniti
*Attorney, Agent, or Firm*—Woodard, Emhardt, Naughton, Moriarty & McNett

[57] ABSTRACT

A golf club has a long shaft with two grips. The club head loft is about 30 degrees, and the sole descends smoothly downward at about 12 degrees from the striking face to a rear edge. The angle from horizontal to the grip axis is 80 degrees, placing the club head close to the golfer's feet. The golfer stands erect and swings the club with an upper grip-to-chest control to hit the ball up for chip shots.

15 Claims, 4 Drawing Sheets

GOLF CHIPPER CLUB CONSTRUCTION

BACKGROUND OF THE INVENTION

1. Field of the Invention:

This invention relates generally to golfing, and more particularly to a club that is constructed and used differently from the usual club for making "chip" shots.

2. Description of the Prior Art:

Efforts to help golfers improve their game have included various improvements in equipment. For putting, various club head designs and markings have been introduced. Also, some putters with long shafts, with a very different technique of usage, have been adopted by some golfers. But for chipping the ball from the fairway onto the green, the typical specialized club is a short-shafted club. Golfers tend to get a lot of wrist action into chip shots with such clubs. It is my opinion that, for most golfers, greater wrist action tends to reduce accuracy of shots. Therefore, this invention is the result of my efforts to improve chip shots.

SUMMARY OF THE INVENTION

Described briefly, according to a typical embodiment of this invention, a golf club is provided with a long shaft. The club head has a bounce portion that extends smoothly rearward from the lower edge of the ball striking face to the rear end of the sole of the club head. With the striking face at a ball-addressing attitude, the bounce portion extends down and to the rear from a horizontal plane containing the lower edge of the striking face. The club shaft has two hand-grip portions, one near the upper end of the shaft, and one farther down on the shaft. The club is held with one hand on the upper grip portion, and the other hand on the lower grip portion. During alignment and while stroking the ball, the upper hand, holding the upper grip portion, is held against the chest, as the lower hand moves the club head through the ball. The angle of the grip portion axis relative to the club head is such as to locate the club head close to the toes of the golfer.

DESCRIPTION OF THE PREFERRED EMBODIMENT

Figure 1:
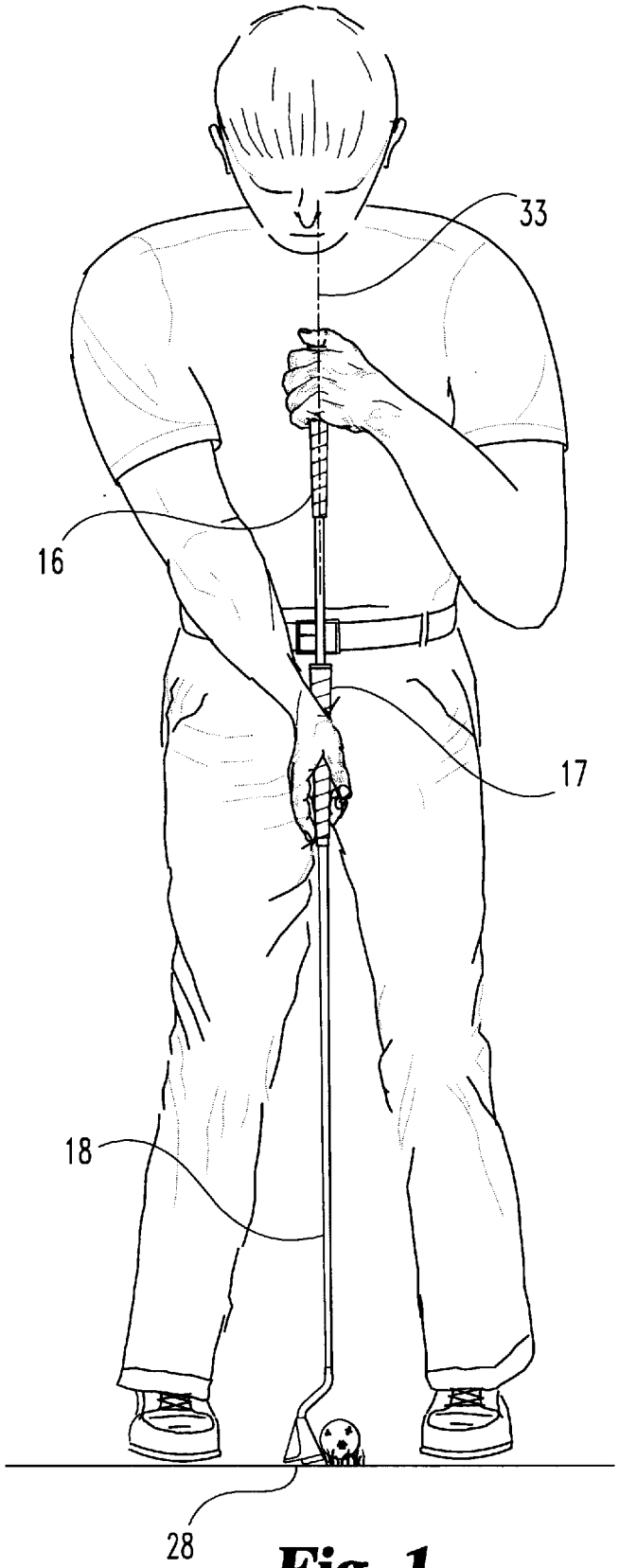
FIG. 1 is an elevational view facing the golfer addressing a ball with the golf chipper club according to this invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 3:
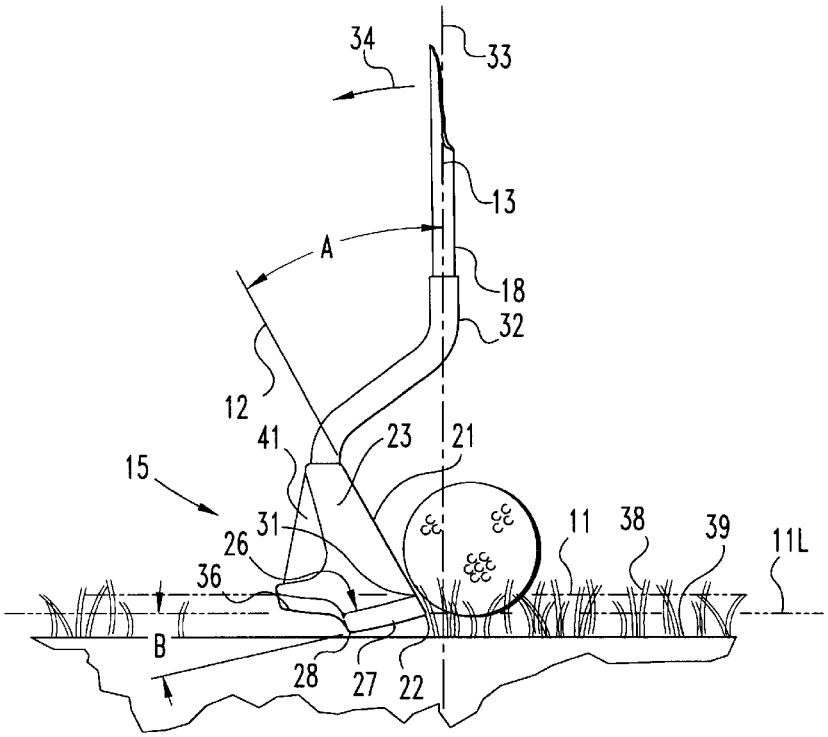
FIG. 3 is an enlarged fragmentary view of the lower portion of the club assembly showing club head features and relationships.
Figure 4:
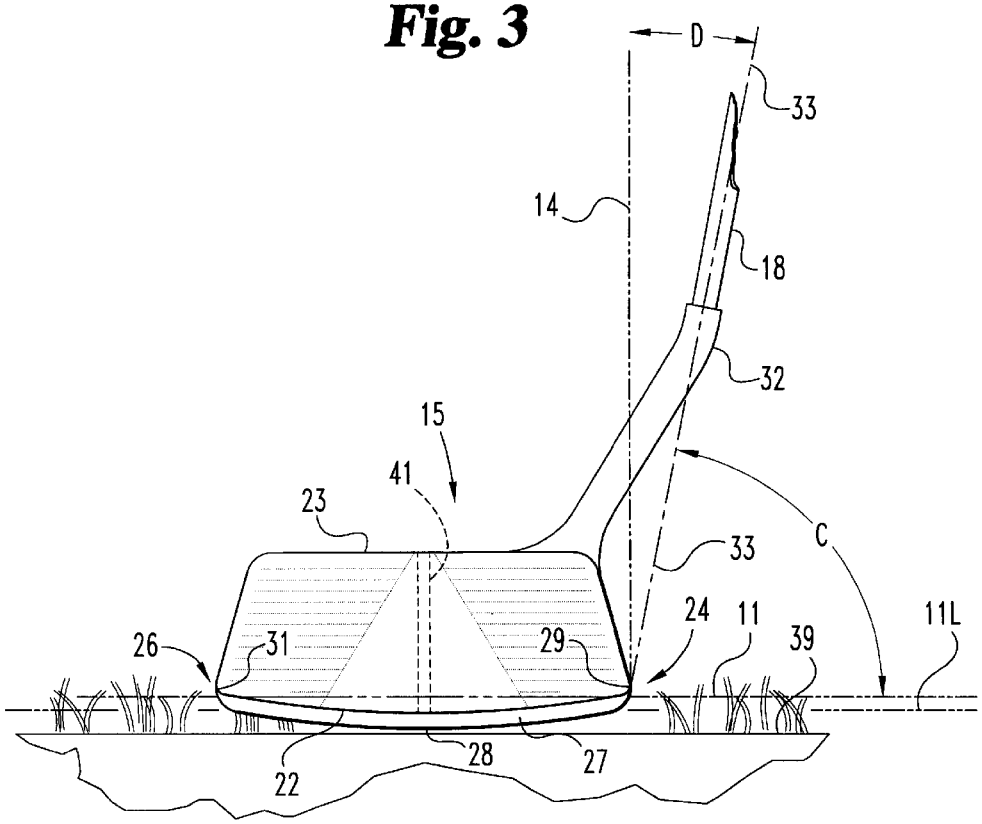
FIG. 4 is an enlarged view similar to FIG. 2 but fragmentary as in FIG. 3.

Referring now to the drawings in detail, and for reference purposes in describing relationships, a horizontal plane 11 is described as a first plane. A plane 12 is the plane of the club head face and is referred to as a second plane. A plane 13 referred to as a third plane, is a vertical plane containing the shaft of the golf club, and is perpendicular to the first plane 11 and, in FIG. 3, is perpendicular to the plane of the paper. A fourth plane 14 (FIG. 4) at the heel of the club head is perpendicular to planes 11, 12 and 13.

The club assembly includes the club head 15, upper and lower hand grips 16 and 17, respectively, and a shaft 18 connecting the grips and the club head. It should be understood that the shaft could be a multiple component assembly, or could be a single piece of material with enlarged and/or textured portions for hand-gripping features. Other specifics of shaft and grip can be employed within the scope of the present invention.

Figure 5:
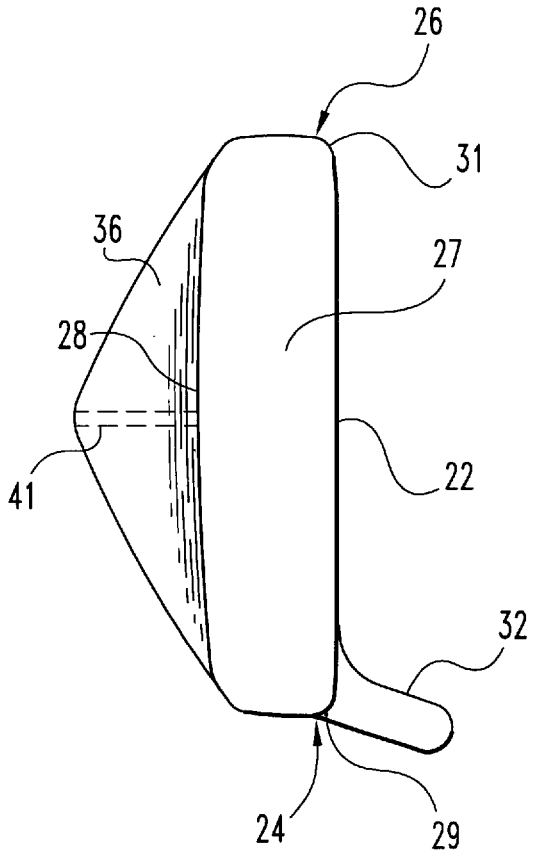
FIG. 5 is a fragmentary bottom plan view thereof.

In many respects, the club head 15 has a flat, ball-striking face 21 which may have decorative or functional features in it such as horizontal lines, for example. The striking face extends from a lower front edge 22 to an upper front edge 23 and from the heel 24 to the toe 26. The bottom of the club head comprises primarily the sole 27 which extends rearwardly from a front or leading edge at the transition from the lower edge 22 of the striking face, to a rear or trailing edge 28 (FIGS. 1, 3 and 5). Two places on the line 22 of transition between the striking face and sole, are at opposite ends, one of them 29, being adjacent the heel of the club head, and the other 31 being adjacent the toe of the club head. The club head also has a hosel 32 extending up from the club head adjacent the heel in the illustrated embodiment. However, although this is the preferred location, it could be located farther out on the club head. The socket in the hosel receives the shaft 18, the socket providing orientation for the shaft. The gripping portions 16 and 17 are colinear on an axis 33 which lies in plane 13. In the illustrated embodiment, the shaft is straight, centered on axis 33, as this is the easiest way to align the grips and connect them to the club head. But it is not essential to the invention that the connecting shaft be entirely straight.

It is preferred that the loft angle "A" (FIG. 3) between the plane 12 of the ball striking face and the plane 13 of the grip axis 33, be between about 25 degrees and 45 degrees, preferably 30 degrees measured in the counterclockwise direction of arrow 34 from plane 13. This is with the shaft axis plane 13 vertical as mentioned above. At the same time, according to one feature of the invention, angle "C" between the grip axis 33 and plane 11 is between about 75 degrees and 85 degrees, preferably 80 degrees. Said another way, the angle "D" between axis 33 and vertical plane 14 is between 5 and 15 degrees, preferably 10 degrees.

With the club head oriented as described to this point, and the transition places 29 and 31 in the horizontal plane 11, and the leading edge 22 at the center of the club face in horizontal plane 11L, another feature of the invention is the downward inclination of the sole 27 from the leading edge 22 to the trailing edge 28 at an angle "B" at a negative (down from horizontal) angle of between 9 degrees and 15 degrees preferably 12 degrees. It is preferable that this angle be constant across the entire width of the sole from the toe to the heel. The bottom of the club turns abruptly upward at the trailing edge 28 of the sole and may feather out to some other feature such as a flange 36, for example, if desired for balancing, decoration or any other purpose desired, but such feature is not necessary to the invention.

Figure 2:
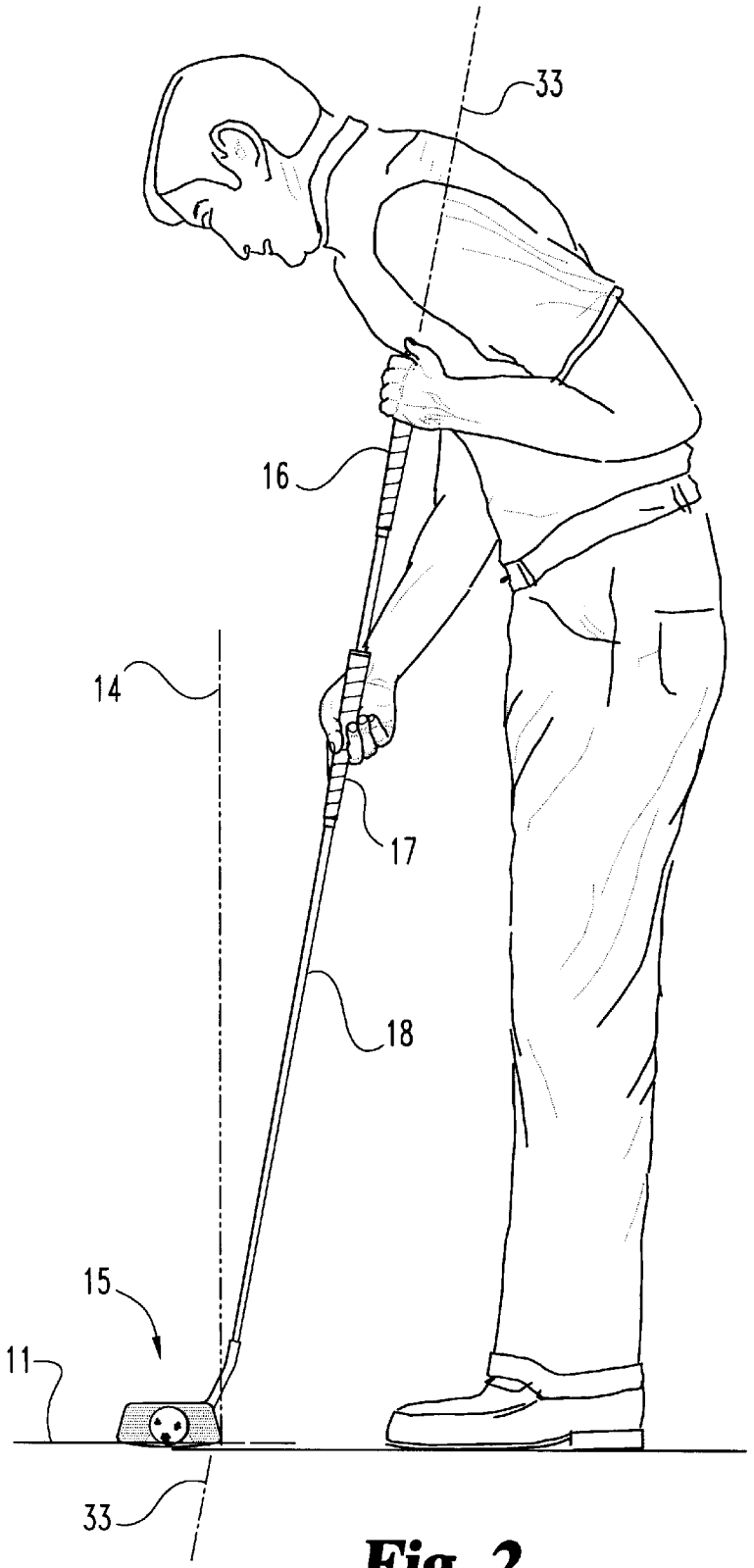
FIG. 2 is a side view thereof.

Another aspect of the invention is the provision of a long shaft with the two gripping areas. It is desirable that, for use by an adult, the overall length of the club from the bottom of the sole at the trailing edge 28 to the top of the upper grip 16 be at least 40 inches. With this combination of features, the club is used in the manner shown in FIGS. 1 and 2. A right-handed golfer standing essentially erect, with the left hand holding the upper grip at the front of the chest, and the right-hand holding the lower grip, and the ball location and intended path of the ball within 6 inches of the toes of the golfer, the golfer merely swings the club in pendulum fashion about the chest. With the above-described loft, and the ball setting in turf grass 38 (FIG. 3) growing from soil 39 is lifted cleanly from the grass, producing a well controlled chip shot without the attendant misdirection, divot-taking result which often occurs when a high handicap, or even better golfer, make a chip shot with a conventional chipper club.

In the foregoing description, the leading edge of the ball striking face is shown as essentially horizontal as is the trailing edge 28 of the sole. For a club assembly according to the present invention, that is the preferred design. It should be appreciated that some slight convex curvature of the leading edge and sole as viewed in FIG. 4 and of the sole as viewed in FIG. 3, may be used within the scope of the invention as long as the radius of such curvature is at least 30 inches.

The overall height of the ball striking face from edge 22 to edge 23 is preferably between 1.25 inches and 2.25 inches. The materials of at the club assembly may be selected from any of a wide variety of materials already known and in use. An alignment or sighting rib 41 may be provided atop flange 36 at the top of the club head, and with a sighting line or mark along its top, if desired. Of course, the invention can be applied to the benefit of a left-handed golfer as well as to a right-handed golfer.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. For a golf club assembly, a club head with a ball-striking face, a sole, a heel portion, and a toe portion, all oriented to an axis for a hand grip, the sole having a leading edge with inner and outer points in a first horizontal plane, and the sole having a trailing edge, the striking face extending upward in a second plane from the leading edge of the sole, the axis lying in a third plane which is vertical and perpendicular to the first plane, and wherein the third plane intersects a fourth plane which is perpendicular to the first and second planes, the improvement comprising:

inclination of the sole downward from the leading edge to the trailing edge at an angle between about 9 and 15 degrees from horizontal as the sole extends rearward from the striking face, and wherein the angle between the axis and the fourth plane, measured in the third plane, is less than 15 degrees.

2. The improvement of claim 1 and further comprising:

a shaft connected to the club head and of sufficient length and location to enable a user of the club assembly while standing erect to simultaneously grip the shaft at a location near an upper end at a location intermediate the upper end and the club head for swinging the club head to strike a ground-supported ball with the striking face.

3. The improvement of claim 2 and wherein:

the overall length of the assembly of the club head and the shaft is at least 40 inches.

4. The improvement of claim 2 and wherein:

the loft of the ball-striking face is between about 25 and 45 degrees measured in one direction from the third plane.

5. The improvement of claim 4 and wherein:

the loft of the ball-striking face is about 30 degrees.

6. The improvement of claim 1 and wherein:

the distance from the leading edge to the trailing edge of the sole is uniform throughout a substantial portion of the distance from the inner point to the outer point.

7. In a golf club assembly having a club head with a portion for connection to a shaft for connection of the club head to a hand grip portion having an axis, the club head having a heel and a toe and a sole having a leading edge and a trailing edge and extending out from the heel to the toe, and the club head having a striking face extending upward from the leading edge of the sole between the heel and the toe, a first transition place where the striking face meets the sole at the heel, a second transition place where the striking face meets the sole at the toe, the first and second places lying in a first plane which is horizontal, the improvement comprising:

orientation of the striking face to lie in a second plane having a loft angle between about 25 and 45 degrees measured in one direction from a third plane which is vertical, perpendicular to the first plane and contains the axis; and inclination of the sole from the first plane as the sole extends rearward from the striking face downward from horizontal at an angle between about 9 and 15 degrees measured in the one direction downward from the first plane;

the grip portion axis lies in the third plane which is perpendicular to the first plane and intersects a fourth plane which is perpendicular to the first and second planes; and the angle between the axis and the fourth plane measured in the third plane is less than 15 degrees.

8. The improvement of claim 7 and wherein:

the downward inclination is maintained to the trailing edge of the sole.

9. The improvement of claim 7 and wherein:

the hand grip portion includes a first hand grip and a second hand grip having colinear axes on said axis; and a shaft connects the club head to the first and second hand grips.

10. The improvement of claim 9 and wherein:

the length of the shaft and hand grip portion from the club head to the end of the grip most remote from the club head is at least 40 inches.

11. The improvement of claim 9 and wherein:

the shaft has a longitudinal axis colinear with the hand grip axes; and the angle between the shaft axis and the fourth plane measured in the third plane is less than 15 degrees.

12. The improvement of claim 11 and wherein:

the angle between the shaft axis and the fourth plane measured in the third plane is between about 5 degrees and 15 degrees.

13. The improvement of claim 8 wherein:

the distance from the leading edge to the trailing edge of the sole is uniform throughout a substantial portion of the distance from the first transition place to the second transition place.

14. The improvement of claim 7 and wherein:

the angle between the axis and the fourth plane measured in the third plane is between about 5 and 15 degrees.

15. The improvement of claim 7 and wherein:

the fourth plane is tangent the heel of the club head;

the axis intersects the fourth plane at the first plane; and the angle between the axis and the fourth plane, measured in the third plane is less than 11 degrees.

* * * * *